United States Patent [19]

Desplats

[11] 3,995,830

[45] Dec. 7, 1976

[54] CABLE TRACTION AND HOISTING APPARATUS

[75] Inventor: Andre Emile Desplats, Boulogne Billancourt, France

[73] Assignee: O.G.E.C., Paris, France

[22] Filed: Dec. 31, 1975

[21] Appl. No.: 645,606

[30] Foreign Application Priority Data

Jan. 3, 1975 France ..... 75.00164

[52] U.S. Cl. ..... 254/76

[51] Int. Cl.[2] ..... B66F 3/00

[58] Field of Search ..... 254/76, 105–107

[56] References Cited

UNITED STATES PATENTS

| | | | |
|---|---|---|---|
| 2,585,101 | 2/1952 | Favre | 254/76 |
| 2,995,339 | 8/1961 | Persiaux | 254/76 |
| 3,222,742 | 12/1965 | Persiaux | 254/76 |
| 3,863,893 | 2/1975 | Cavalieri | 254/76 |

*Primary Examiner*—Al Lawrence Smith
*Assistant Examiner*—Robert C. Watson
*Attorney, Agent, or Firm*—Ulle C. Linton

[57] ABSTRACT

The release control lever 14 is mounted on a shaft 15 passing through the casing 1 of the apparatus and which is rigid with a crank-shaft 19. The crank-shaft 19 is connected through a rod 20 to the middle portion 21 of a rocking lever 17 pivoted at one end to the control links of clamp 5 and at the other end to a rod 18 pivoted in turn to one end of another rocking lever 16 having its other end pivoted to the control links of clamp 4 while its middle portion 22 is connected to a fixed pin 23. The rotation of the release control lever 14 results in a translation of rocking lever 17 and a rotation of rocking lever 16.

2 Claims, 1 Drawing Figure

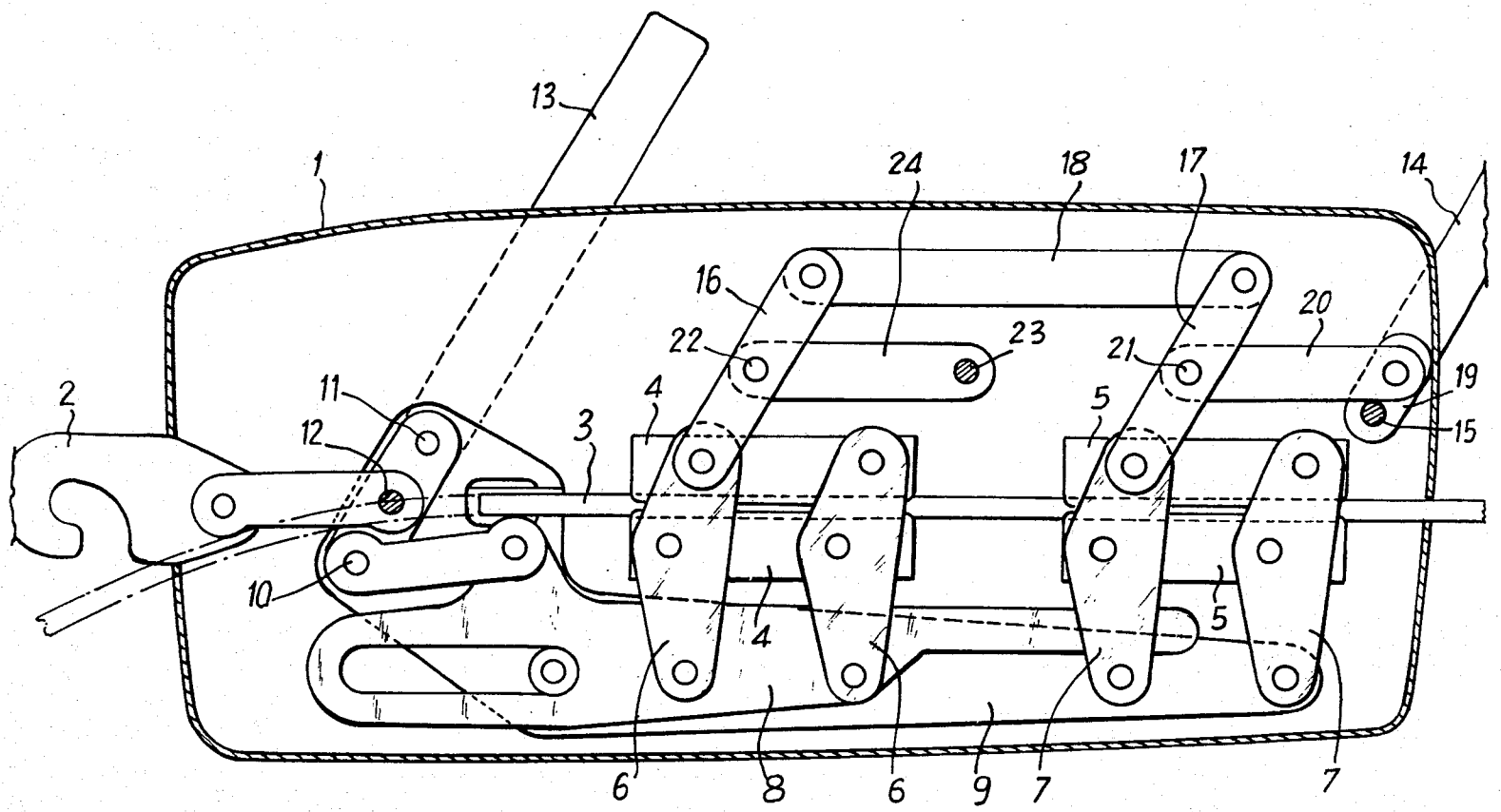
1
2
3
4
5
6
7
8
9
10
11
12
13
14
15
16
17
18
19
20
21
22
23
24

CABLE TRACTION AND HOISTING APPARATUS

BACKGROUND OF THE INVENTION

The present invention relates in general to traction and hoisting apparatus of the type operating by means of selfclamping jaws, and has specific reference to an improved apparatus of this type adapted to claim a loaded metal cable.

BRIEF DESCRIPTION OF THE PRIOR ART

Metal-cable traction and hoisting apparatus are already known, notably according to U.S. Pat. No. 2,585,101, wherein a pair of self-tightening clamps are coupled to a crank-shaft the axle of which is rigid with the casing of the apparatus and act on the cable according to a reciprocating movement.

These apparatus comprise two complementary cinematic connections, each operated through a separate lever, the one ensuring the hauling of the cable and the other ensuring the release of the cable in co-operation with the preceding connection.

In a known type of apparatus, particularly according to U.S. Pat. No. 2,585,101, the cinematic connection ensuring the release of the cable comprises a rocking lever of which the axle of rotation is necessarily free in order to adjust the position of this rocking lever according to the position of the clamp jaws on the cable, as a function of the mechanism wear or of the cable diameter. So the rocking lever is likely to receive a stress such to provide its end portions with parallel and of same direction displacements. Such a movement results, in the known apparatus, in a simultaneous opening of the jaws of the two clamps thus releasing the load attached to the cable.

SUMMARY OF THE INVENTION

The present invention has for its object to realize, in a manner more simple and more sure than in the known apparatus, a cinematic connection for the release of the cable which is so conceived that on the one hand no movement of this connection can provide a displacement in the same direction of the links actuating respectively each clamp and that, on the other hand, said links can automatically adjust their positions to the degree of wear of the mechanism or to the cable diameter.

In order to obtain an apparatus confined within an entirely closed casing and thus to avoid the introduction of foreign bodies into the mechanism, the release control lever may be mounted as the hauling control lever that means the release control lever is fixed outside of the casing on the axle passing through said casing as it is described hereunder. So the casing opening which exists on the greatest part of the known apparatus and which is adapted on such apparatus to allow the passage of the release control lever may be suppressed in a particularly simple and easy manner.

BRIEF DESCRIPTION OF THE DRAWING

A clearer understanding of the invention will be had as the following description proceeds with reference to the accompanying drawing illustrating diagrammatically by way of example a typical form of embodiment of the apparatus constituting the subject-matter of the invention, the single FIGURE of this drawing being a side elevational and sectional view of the apparatus.

DESCRIPTION OF THE PREFERRED EMBODIMENT

The apparatus, which is of a generally known type, comprises and elongated casing 1 provided at one end with an anchoring hook 2 and through which passes longitudinally a hauling or release cable 3 to which a load (not shown) is attached on the side opposite to the hook 2. Thus the load is hauled when the cable 3 is pulled from the right hand side to the left hand side when looking at the FIGURE and the load is released when the cable 3 is allowed to move in the opposite direction. The cable 3 passes through two pairs of jaws 4–5 belonging to a pair of clamps which slide longitudinally while performing rectilinear reciprocating movement in opposite directions, one of said clamps moving with the cable on which its jaws are gripped while the other clamp is released and slides along the cable in the direction opposite to the direction of motion of the cable. It will be understood that, when hauling the cable 3, the gripped clamp is the one moving from the right to the left when looking at the FIGURE and that the gripping action is reversed from one clamp to the other when the direction of motion of the clamps is reversed. To this end, the clamps 4–5 are respectively connected through links 6–7 to a pair of levers 8–9 presenting opposite sliding movements, said levers 8–9 being coupled respectively to the crank pins 10–11 of a crank-shaft of which the axle 12, which passes through the casing 1, is rigid with a hauling control lever 13, the action being such that the operation of the hauling control lever 13 tends to grip the clamp which is moved towards the anchoring hook 2 and to ensure the hauling of the load. This known apparatus is generally provided with a release control lever which is so connected to the clamps as to ensure, on the contrary, the gripping of the clamp which moves apart from anchoring hook 2 while releasing the other clamp, so that the load may move back and stand away from the apparatus, for example under the action of the load weight. It will be seen on the drawing that the pivoting of links 6–7, in the clockwise direction, tends to grip the clamps while a reversed pivoting of these links ensures the release of the clamps.

The invention has for its object to provide a new release control device avoiding the risks of a faulty operation which could result in a simultaneous opening of the two clamps and automatically fitting to variable positions imposed by the progressive wear of the traction cable.

According to the invention the release control lever 14, which is adapted to pivot reciprocally and is rigid with a pin 15 disposed in a fixed position in the casing 1, acts on the links 6–7 controlling the two clamps 4–5 through a pair of rocking levers 16–17 pivoted at one end to the links 6–7 and interconnected at their other ends by means of a rod 18. The release control lever 14 is connected through a pivoting arm 19 and a link 20 to an intermediary point 21 located at the middle portion of rocking lever 17, which is thus pulled according to a translation movement, while the rocking lever 16 is connected, at an intermediary point 22 located at its middle portion, to a fixed point 23 through a link 24, so that the rotation of the release control lever 14 causes a rotation of this rocking lever 16.

It will be noted that, with a view to simplify the drawing, the pre-clamping springs which tend to return the clamp jaws in their gripping positions have been omitted and that the connection between the two jaws of each clamp is adapted, in a known manner, to provide a self-clamping action that means that, due to the friction of the cable on the pre-clamped jaws, the load tends to automatically increase the gripping action of the clamps on the cable when a contrary action is not exerted on the clamps by the links 6–7.

The operation of the release control device according to the invention may be readily understood. When the release control lever 14 is pivoted from the position shown in the FIGURE toward the left hand side of the FIGURE, the rocking lever 17 is submitted to a translation toward the left while the rocking lever 16 rotates in the direction opposite to the clockwise direction, thus pulling the link 6 toward the right that ensures the gripping of clamp 4 then its movement toward the right while the clamp 5 is released and moved toward the left. The cable 3 thus accompanies clamp 4 from the left to the right of the FIGURE in the release direction. When the pivoting movement of lever 14 is reversed, clamp 5 is gripped and is pulled toward the right while clamp 4 is released and is moved toward the left, that still results in a cable release movement.

As the wear of the cable occurs, the rocking levers 16–17 can slightly pivot together in the clockwise direction without causing some trouble in the operation of the device as described hereinabove.

It will be noted that the release control lever 14 may be actuated manually or may be coupled in a reciprocating manner to a rotating or rectilinear driving member such as a hydraulic jack.

What I claim is:

1. Cable traction and hoisting apparatus comprising, within a casing, a pair of clamps reciprocally movable within the casing and adapted alternatively to grip or release the cable, a hauling control lever mounted on a first shaft passing through the casing, said first shaft being rigid with a first crank shaft connected through control levers and links to said clamps to control the movement of the clamps resulting in the hauling of the cable, a release control lever mounted on a second shaft passing through the casing and being rigid with a second crank shaft connected through a rod to the middle portion of a first lever, said first lever being pivoted at one end to the control links of one clamp and being connected at its other end, through a rod, to one end of a second lever, said second lever being pivoted at its other end to the control links of the other clamp and having its middle portion pivoted about a fixed axis, so that a rotation of the release control lever results in a translation movement of said first lever and a rotation movement of said second lever.

2. Cable traction and hoisting apparatus comprising, within a casing, a pair of clamps reciprocally movable within the casing and adapted alternatively to grip or release the cable, a hauling control lever mounted on a first shaft passing through the casing, said first shaft being rigid with a first crank shaft connected through control levers and links to said clamps to control the movement of the clamps resulting in the hauling of the cable, a release control lever mounted on a second shaft passing through the casing and being rigid with a second crank shaft connected through a rod to the middle portion of a first lever, said first lever being pivoted at one end to the control links of one clamp and being connected at its other end, through a rod, to one end of a second lever, said second lever being pivoted at its other end to the control links of the other clamp and having its middle portion connected, through a rod, to a fixed axis, so that a rotation of the release control lever results in a translation movement of said first lever and a rotation movement of said second lever.

* * * * *